United States Patent [19]

Matthews

[11] Patent Number: 4,824,119

[45] Date of Patent: Apr. 25, 1989

[54] BACK SPELLING CARD GAME

[76] Inventor: Charles C. Matthews, 3618 Tindall Ct., Fayetteville, N.C. 28311

[21] Appl. No.: 208,472

[22] Filed: Jun. 20, 1988

[51] Int. Cl.[4] ..... A63F 1/04

[52] U.S. Cl. ..... 273/308; 273/302

[58] Field of Search ..... 273/292, 302, 308

[56] References Cited

U.S. PATENT DOCUMENTS

| | | | |
|---|---|---|---|
| 1,292,184 | 1/1919 | Wells | 273/302 X |
| 1,745,946 | 2/1930 | Murray | 273/308 X |
| 3,068,010 | 12/1962 | Hagopian | 273/302 X |

*Primary Examiner*—Anton O. Oechsle

*Attorney, Agent, or Firm*—Rhodes, Coats & Bennett

[57] ABSTRACT

The present invention entails an educational and entertainment card game comprising a deck of fifty-one cards with each card containing the outline of a state and a two letter abbreviation of the state. Two or more players are each dealt five cards and given an option to exchange one card for another card in the deck. Each player then attempts to identify his or her cards by writing and correctly spelling the state represented by each card. The players then write and spell the state names backwards and underline any words contained within the backward spelled states. Finally, the capitol, bird, tree, and flower of each identical state are written down. A designated judge determines a time limit for play and awards points to each individual for correct written information. At the end of the time limit, a new hand is dealt and play continues until a player scores a predetermined number of points.

10 Claims, 1 Drawing Sheet

BACK SPELLING CARD GAME

FIELD OF INVENTION

The present invention relates to games and particularly card games.

BACKGROUND

Many people, both young and old, do not even have a basic knowledge of the fifty-one individual states of the United States. This ignorance can cause problems in a person's ability to effectively function in today's society. For example, newspaper and magazine articles often refer to states by the states' two letter abbreviations. If the person reading the article does not know what state is being referred to then he or she will not be able to follow the article and will remain uninformed. There are many other instances when basic knowledge of the U.S. states would be needed, and a method and apparatus is needed to teach more people about our fifty-one states.

Recent studies have shown a large percentage of people in this country are ignorant of U.S. geography and cannot identify the U.S. states on a map. Evidently, the methods and apparatuses available now are not serving the function of teaching basic U.S. geography. There are patents on card games that do print U.S. state names and other state information on cards, but the games are not very effective in helping people retain knowledge about our states.

There is a need for an enjoyable game that helps people retain knowledge about the fifty-one states of the U.S. The present invention provides a game that is enjoyable, so people will want to play, and a game that helps people retain information concerning U.S. states.

SUMMARY AND OBJECT OF THE INVENTION

The present invention is an enjoyable game that helps people retain information about the states of the U.S.A.

In particular, the invention is a competitive card game with a deck of fifty-one cards, each card containing a border outline and two letter abbreviation of a U.S. state. A dealer distributes from the card deck five cards to each of the two to ten players participating in the card game. Each player is then given an option to exchange one of his or her cards for a new card remaining in the deck of cards. From either the outline of the individual state or the two-letter abbreviation of the state, the players attempt to identify the cards held within their own hands within a specific time limit. A judge begins timing when all the players have their final five cards and also indicates when the time limit has expired.

The object of the game is to be the first player to reach a game-winning, predetermined number of points. To earn points the players identify the state represented by a card by writing and correctly spelling the state's name on a piece of paper. Additional points are earned by writing the state name backwards and then underlining words contained within the back spelled state. Further points are then earned by identifying and writing the state's capitol, bird, tree, and flower. At the end of the time limit the judge checks the players answers against a master checklist containing the correct answers. The points earned by each player for correct answers are tallied by the judge and recorded. If the game winning, predetermined number of points has not been reached by any of the players then the cards are redealt and play continues as previously described until one player has earned enough points to be declared the winner.

By actually writing the information concerning the U.S. states down, the players are able to retain the information much more effectively than if the information is just spoken. Also, correctly spelling, writing the state backwards, and then underlining words within the back-spelled state firmly fixes the state information in the player's mind. Similarly, writing down interesting information about each state also gives a better understanding of the states and helps players correctly associate the state with pertinent facts.

It is therefore an object of the present invention to provide an effective educational card game.

Another object of the present invention is to provide an interesting and fun card game.

Another object of the present invention is to provide a competitive card game requiring skill and knowledge.

Another object of the present invention is to provide a game that effectively teaches useful information concerning the states of the United States.

Another object of the present invention is to have players give written answers in order to increase the amount of material learned and remembered.

Another object of the game is to increase the players' knowledge and interest in U.S. states.

Other objects and advantages of the present invention will become apparent and obvious from a study of the following description and accompanying drawings which are merely illustrative of such invention.

BRIEF DESCRIPTION

DETAILED DESCRIPTION OF THE INVENTION

Figure 1:
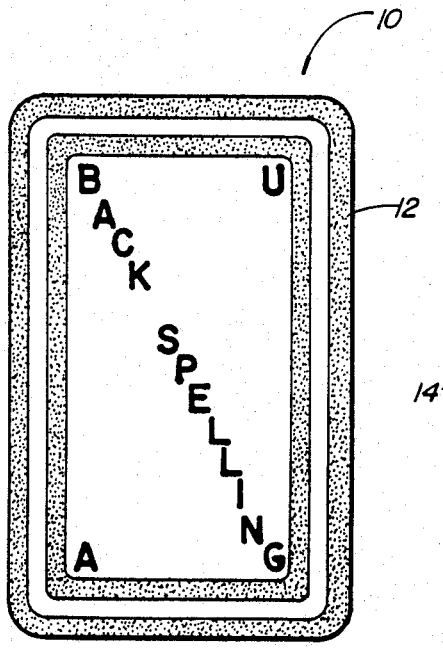
FIG. 1 is a top plan view of a representative playing card of the card game of the present invention.
Figure 2:
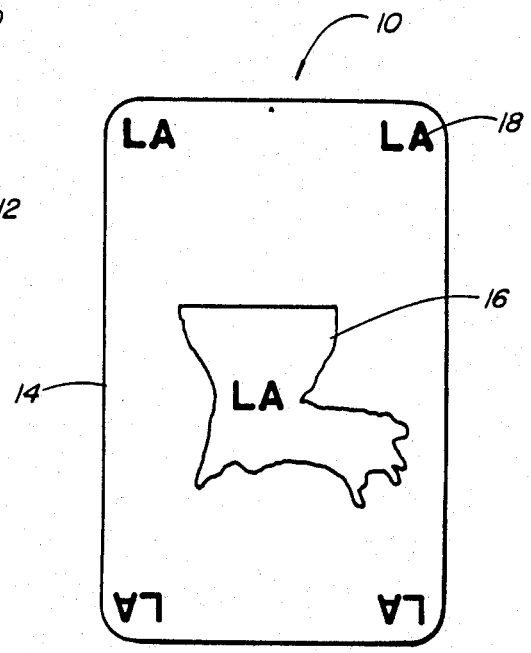
FIG. 2 is a bottom plan view of a representative playing card of the card game of the present invention.

With further reference to the drawings and following description, the present invention card game is illustrated therein and in particular, a representative playing card 10 of the fifty-one total playing cards of the present invention is illustrated in FIGS. 1 and 2. The top side 12 of each playing card 10 as shown in FIG. 1, is identical. The bottom side 14 of each playing card 10, as illustrated in FIG. 2 contains an outlined shape of a state 16 and two letter abbreviation 18 representing the state. Each of the fifty-one U.S. states are represented by a single playing card with an outlined state shape 16 and corresponding state abbreviation 18.

In playing the present card game, a dealer shuffles and then deals to each of two to ten players a hand of five playing cards 10. After viewing his or her individual hand, a player may choose to exchange one playing card 10 for another playing card 10 remaining in the deck of playing cards 10. The dealer individually asks each player, in a clockwise order, whether he or she chooses to exchange a playing card 10. If the player does choose to exchange a playing card 10 then the player says "card", and a new playing card 10 is dealt from the deck of playing cards 10 to the player and the player's discarded playing card 10 is returned to the deck. In this manner, there will always be a sufficient number of playing cards 10 remaining in the deck to provide an exchange playing card 10 despite the number of allowed players. By discarding a playing card 10 that can not be fully identified, a player may receive an identifiable exchange playing card 10 and thus improve his or her score.

Once all of the players have been given the option to exchange a single playing card 10, the judge begins a five minute time limit, with a watch, in which players may write answers on a piece of paper corresponding to the cards held in his or her hand. For each playing card 10 held, the player attempts to write and correctly spell the state represented by the individual playing card 10. The state name is then written backwards and words, excluding "a" and "I", contained within the backspelled words are underlined. Finally, the state's capitol, tree, bird, and flower are all written down if known. The player attempts to answer each playing card 10 in this way until the time limit ends and is announced by the judge.

At the end of the time limit, the judge checks each players responses and playing cards 10 with a master checklist, and then awards the appropriate number of points to each player. The master checklist is an ordered listing of each state, state abbreviation 18, state capitol, state tree, state bird, and state flower. Two points are awarded for each correctly identified state, and an additional three points are earned for a correct spelling of the state name. If the state name is correctly spelled backwards then five points are awarded for each underlined word contained within the backspelled state. Finally, five points are awarded for each correctly identified state capitol, bird, tree or flower. The player is awarded full points for identifying these state symbols whether or not they are spelled correctly. The total number of points for each playing card is then added to determine the total score for that particular playing card.

An example response by a player and the subsequent scoring for the playing card shown in FIG. 1 is presented below:

| | Score |
|---|---|
| State: Louisiana | 5 |
| Backspelling and Word Identification: ANAISIUOL | 10 |
| Capitol: Baton Rouge | 5 |
| Tree: Cypress | 5 |
| Flower: Magnolia | 5 |
| Bird: Brown Pelican | 5 |
| Total Points: | 35 |

The state represented by the outlines shape 16 and abbreviation 18 is Louisiana. The player is awarded two points for correct identification of the state and an additional three points for correct spelling, for a sum score of five points. For correctly backspelling the state and underlining the words "an" and "is" contained within the backspelled word, the player is awarded five points for each underlined word for a sum score of ten points. Likewise, five points were awarded for each correctly identified state capitol, tree, flower, and bird. The total number of points awarded for this particular playing card 10 is thirty-five points.

All playing cards 10 in a player's hand are scored by the judge in this way to determine the total points for each players individual hand. The first player to reach a score of three-hundred points or more is declared the winner of the game. At the end of the first hand, if no player has reached three-hundred or more points then the deal is rotated clockwise. The new dealer shuffles and deals the playing cards as previously described. Play continues in this manner until a player has reached the game winning score of three-hundred points or more. If two players both reach three-hundred points or more in the same hand then the player with the highest score winds the game. In case of a tie at three-hundred points or more, the tied players continue play until one player earns more points than the other previously tied players.

Obviously, other game-winning total point values can be used by the players. Likewise, variations of the present invention card game can be developed by the players. For example, two-player teams may be formed to introduce team competition to the card game. These minor variations do not alter the essence of the present invention, but only add to the diversity of the card game.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of playing a card game wherein the card game includes a plurality of playing cards each representing an individual item, the method of playing said card game comprising the steps of: dealing a set of playing cards to a plurality of players; first, identifying said playing cards by writing the names of said items represented by said playing cards; next, writing the identified items backwards; underlining words contained within said backwards spelled items; and awarding points to players according to how players perform said steps.

2. The card game method of claim 1 wherein each said playing card represents a state of the United States.

3. The card game method of claim 2 wherein each said playing card represents a state of the United States through an abbreviation of the state name.

4. The card game method of claim 3 wherein each said playing card represents a state of the United States through an outline of the shape of the state.

5. The card game method of claim 1 wherein the card game further includes a step of identifying in writing various symbols and information associated with said represented items.

6. The card game method of claim 1 further including a step of being given the option to discard one or more said playing cards from said set of playing cards for new said playing cards.

7. The card game method of claim 1 further including a time limit in which play must be completed.

8. The card game method of claim 1 wherein a player is declared the winner when the sum total of points awarded to that player is greater than a certain number of points.

9. A method of playing a back spelling card game wherein the card game includes a plurality of playing cards each representing an individual state, the method of playing said card game comprising the steps of: dealing a set of playing cards to a plurality of players; first, identifying said playing cards by writing the names of states represented by said playing cards; next, writing the identified states backwards; underlining words contained within the backwards spelled states; and awarding points to players according to how players perform said steps.

10. The card game method of claim 1 wherein the card game further includes a step of identifying in writing various symbols and information associated with said states.

* * * * *